United States Patent [19]

Kalb

[11] 3,973,591

[45] Aug. 10, 1976

[54] MULTI-PORT CONTROL VALVE

[75] Inventor: Hans Kalb, Nurnberg, Germany

[73] Assignee: AEG-Kanis Turbinenfabrik GmbH, Nurnberg, Germany

[22] Filed: Sept. 25, 1974

[21] Appl. No.: 509,051

[30] Foreign Application Priority Data

Oct. 4, 1973 Germany ..... 2350263

[52] U.S. Cl. ..... 137/625.12; 251/343

[51] Int. Cl.[2] ..... F16K 11/07

[58] Field of Search..... 137/625.12, 625.3, 625.48, 137/613, 609, 625.11, 625.42, 625.5, 627, 625.38, 625.39; 251/343, 344, 367

[56] References Cited

UNITED STATES PATENTS

| | | | |
|---|---|---|---|
| 811,987 | 2/1906 | Wilkinson | 137/625.48 X |
| 1,254,599 | 1/1918 | Irwin | 137/625.12 |
| 3,106,939 | 10/1963 | Flick | 251/367 X |
| 3,766,935 | 10/1973 | Clippard | 137/625.11 X |
| 3,771,562 | 11/1973 | Curran | 137/625.48 |
| 3,774,638 | 11/1973 | Kriett | 137/625.48 |
| 3,809,126 | 5/1974 | Oberle | 137/613 X |

*Primary Examiner*—William R. Cline
*Attorney, Agent, or Firm*—Spencer & Kaye

[57] ABSTRACT

A valve particularly for controlling the admission of fluid to sectional nozzles of a turbine has a slidable valve sleeve provided with a control face. The valve sleeve is surrounded by a stack of valve rings fixedly held in the sequentially housing. Each valve ring has a circumferentially extending axial extension with which it engages an adjoining valve ring of the stack. Each axial extension has at least one discontinuity to define a port between any two valve rings. Ports associated with different valve rings communicate with different nozzle sections. As the valve sleeve is moved in one direction, its control face equentially opens the valve ports associated with the different nozzle sections.

7 Claims, 3 Drawing Figures

MULTI-PORT CONTROL VALVE

BACKGROUND OF THE INVENTION

For the power or speed regulation of turbines, particularly those operating on compressible fluid, such as steam or gas, often sectional nozzles are used, the inlet of which is conventionally governed by valves. A separate valve is provided for each of the nozzle sections and an appropriate cam shaft actuating device is necessary for the positioning of the different valve stems. Such an arrangement is relatively expensive and needs skillful adjustment of the cam shaft.

Further, each valve normally consists of a stem, which must be sealed from the atmosphere, a valve element which is fixed to or connected with the stem and which must fit exactly into its own seat, so that no fluid flow is admitted to the turbine by the respective valve in the closed state.

In order to actuate the stem of the valves, either large forces are often necessary or duplex poppet valves or balanced steam admission valves are used. The latter are of expensive construction.

It is therefore an object of the invention to provide a sectional nozzle control valve which needs only small actuating forces.

It is a further object of the invention to reduce the number of valve stems and cam devices, more particularly, to reduce the number to only one each or none at all regarding the cam devices, regardless of the number of nozzle sections.

It is also an object of the invention to provide a sectional nozzle control valve which is neither bulky nor expensive but nevertheless ensures a precise nozzle control.

SUMMARY OF THE INVENTION

All these objects are achieved by a sectional nozzle control valve comprising an axially slidable hollow cylindrical sleeve forming an inner valve member and a stack of valve rings surrounding the sleeve and forming an outer valve member. The valve rings are supporting each other by circumferentially extending axial extensions which are interrupted circumferentially to define valve ports. The extensions and the ports alternate circumferentially in an axial plane of each valve ring.

The valve sleeve which has a control face to open or close the valve ports, is operated by a rod connected thereto and introduced from the outside through a fluid tight seal into the casing of the valve. The several valve ports are sealed from each other by piston rings mounted in each of the valve rings. In the valve casing there are provided passages communicating with the valve ports and with the nozzle sections for admitting fluid to the turbine.

DETAILED DESCRIPTION OF THE PREFERRED EMBODIMENTS

Figure 1:
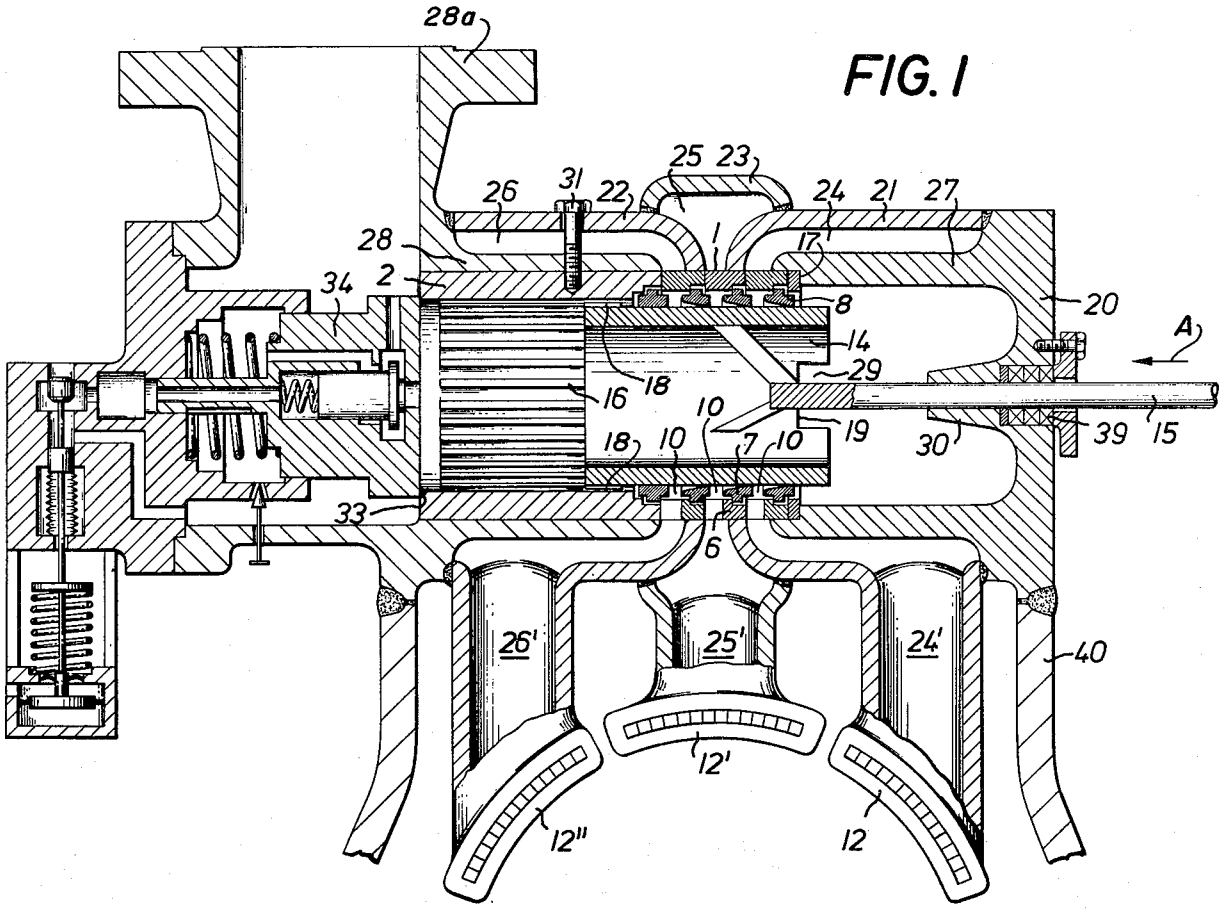
FIG. 1 is a cross-sectional view of the turbine intake, incorporating a preferred embodiment of the control valve according to the invention.
Figure 2:
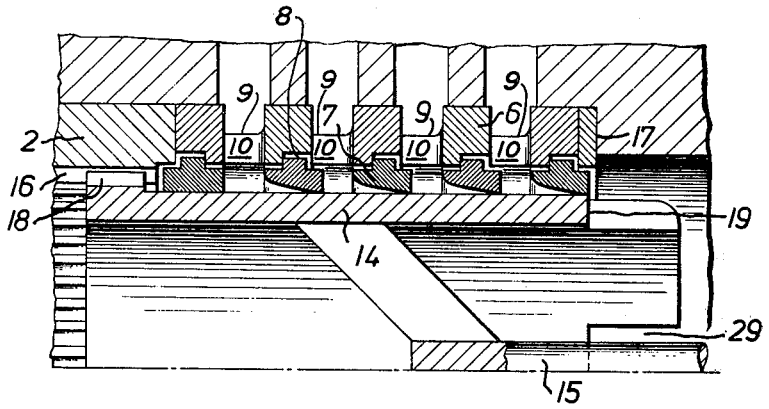
FIG. 2 is a fragmentary axial sectional view of the same embodiment on an enlarged scale.

Turning now to FIGS. 1 and 2, the sectional nozzle control valve according to the invention includes a valve sleeve 14 moving in an axially assembled cylindrical bushing 2 and a stack 1 of valve rings 6, arranged in an axial series. Each valve ring 6 carries a piston ring 7 arranged radially inwardly of the valve ring. The valve casing is composed of several parts 20, 21, 22, 23 and 28 and is partly integral with the nozzle part at the intake opening 40 of the associated turbine casing. The part 28 includes a coupling flange 28a defining the fluid inlet for the control valve. The nozzle part has several nozzle ducts 24', 25' and 26' for the fluid entering the turbine through the nozzle sections 12, 12' and 12''. The nozzle ducts 24', 25' and 26' continue in passages 24, 25 and 26 formed in the casing of the control valve by cylindrical end and middle parts 20, 28 and 23, respectively, and intermediate bellshaped parts 21 and 22 which surround the end parts 20 and 28. The casing parts are all welded together to form a rigid unitary structure. A rod 15 is connected to the sleeve 14 which is actuated by a servo-motor (not shown) in a conventional manner. The rod 15 is sealed at its guidebush 30 by a gland 39 which is the only seal required for the entire valve casing. The valve rings 6 are in engagement with one another by axial extensions 9, each formed of circumferential sections. Between these sections free spaces are provided that constitute radial ports 10 between two valve rings 6 of the valve ring stack 1. The ports 10 continue in passages 24, 25 or 26. By axial movement of the sleeve 14 in the direction of arrow A the ports 10, by virtue of a control face 19 provided on the sleeve 14, are successively opened and consequently, the fluid which is entering the control valve by the valve seat 33, in case the emergency valve 34 (which does not form part of the invention) is in the open position, is successively admitted to the nozzle sections 12, 12' or 12'', according to the rate of power of the turbine. It is thus seen that as the sleeve 14 moves in the direction of the arrow A, that port 10 is opened first which is the farthest downstream of the inlet opening formed in the casing part 28. The fluid ejected by the nozzle sections then impinges on the blades of the rotor of the turbine with high velocity. As it is also apparent from FIG. 1, the fluid, after leaving the emergency valve 34, passes through the inside of the axially open sleeve 14 towards the right, emerges from the sleeve 14 and flows radially thereto into opened ports 10.

The ports 10 are sealed from each other by piston rings 7, which are retained in a groove 8 of each valve ring 6. The piston rings 7 are supported by the axial walls of the grooves 8 against the axially directed pressure of the fluid. Such a support is only effective regarding the inner rings when the respective port 10 is at least partly opened. This is the case when the valve sleeve 14 has moved sufficiently far in the direction of the arrow A, so that the control face 19 of the sleeve 14 has at least partly moved into the space between two consecutive piston rings 7. The other piston rings which are associated with the still-closed ports 10, have a free play, so that they can exactly be adjusted in their position with regard to the sleeve by the sleeve itself.

The sleeve 14 itself is centered at its one end by an external toothing 18 which is provided on the sleeve 14 and an internal toothing 16 provided on the cylindrical bushing 2 over the inner cylindrical surface thereof. As particularly well seen in FIG. 2, the toothings 16 and 18 form an interengaging spline assembly (which is expediently of thermoelastic design) for preventing the sleeve 14 from rotating with respect to the bushing 2. The distances between the piston rings 7 are determined by the height (axial length) of the valve rings 6 and their extensions 9 according to the sectional area of each nozzle in order to achieve the desired rate of fluid admission to the turbine. According to the shape of the sleeve faces 19 or the respective sleeve spaces 29 a characteristic curve of admission of the fluid as a function of the position of the valve sleeve 14 can be achieved, including a certain overlap in the course of opening of the ports 10. For facilitating the mounting of the stack 1 of valve rings 6, the rings 6 and the cylindrical bushing 2 can be clamped together by long screws which may extend through the whole stack, especially through the axial extensions 9. The latter may be radially widened at the locations where such screws pass. In case of a clamped bushing and ring assembly only one screw bolt 31 is needed to hold all of the parts fixed in a position in which they are supported by an abutment ring 17 held in the valve housing. As seen particularly well in FIG. 2, the inner axial wall of the piston rings 7 conically flare to provide favorable fluid dynamic conditions. Advantageously, the piston rings 7 have an axially oblique joint, which becomes sealed by itself when the rings are charged by the pressure of the fluid.

Figure 3:
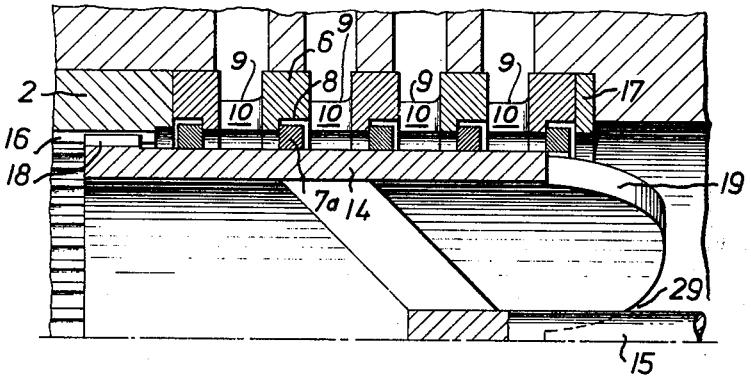
FIG. 3 is a fragmentary axial sectional view of a modified embodiment.

FIG. 3 illustrates piston rings 7a of modified construction. It is seen that — as opposed to the piston rings 7 shown in FIGS. 1 and 2 — the piston rings 7a have a rectangular cross section and thus their inner axial wall is cylindrical.

The above-described valve structure is very compact, needs little space and material for governing the flow of fluid to a turbine with sectional nozzle control.

It is to be understood that the above description of the invention is susceptible to various modifications intended to be comprehended within the meaning and range of equivalents of the appended claims.

It is apparent that, instead of welding the valve unit to the turbine casing 40, a joint may be used; further, the turbine casing and the valve unit, including the nozzle sections 12, 12′ and 12″ may be connected by flanges and screw bolts as it is well known in conventional turbine construction, e.g. in the case of nozzle boxes.

I claim:

1. In a control valve including a housing; means defining an inlet opening; an axially movable valve member formed of a hollow valve sleeve open at both ends; means defining a plurality of outlet ports arranged in an axial series parallel to the path of motion of the valve sleeve; a control land provided on the valve sleeve for sequentially opening the outlet ports upon motion of the valve sleeve in one direction; a rod attached to the valve sleeve and projecting outwardly of the valve housing for displacing the valve sleeve; the improvement wherein said means defining a plurality of outlet ports comprising a plurality of valve rings surrounding said valve sleeve and arranged in a series coaxial with said sleeve; each valve ring having a circumferentially extending, axially projecting extension engaging an adjoining one of said valve rings; each said axial extension having at least one discontinuity defining an outlet port between any two adjoining valve rings; and means for immobilizing said valve rings in said housing.

2. A control valve as defined in claim 1, wherein the path of fluid flow passes unidirectionally through the inside of said valve sleeve, said valve sleeve having an upstream end and a downstream end; said control land being provided at said downstream end of said valve sleeve for opening, upon movement of said valve sleeve in the upstream direction, that one of said outlet ports first, that is situated the farthest downstream of said inlet opening.

3. A control valve as defined in claim 1, each said valve ring including means defining a groove; the improvement further comprising a separate piston ring accommodated and held in each groove; the piston rings having an inner axial face slidably engaging an outer cylindrical face of said valve sleeve; said piston rings sealing said outlet ports from one another.

4. A control valve as defined in claim 3, wherein said inner axial face is cylindrical.

5. A control valve as defined in claim 3, wherein said inner axial face is conically flared in one direction of the axis of said valve sleeve.

6. A control valve as defined in claim 1, further comprising means defining, in said valve housing, outlet passages separated from one another; each outlet passage communicating with a separate one of said outlet ports; each outlet passage leading to a separate sectional nozzle of a compressible fluid turbine.

7. A control valve as defined in claim 1, further comprising a first toothing surrounding said sleeve and immobilized in said valve housing; each tooth of said first toothing extending parallel to the direction of motion of said valve sleeve; a second toothing affixed to an outer cylindrical surface of said valve sleeve; said first toothing meshing with said second toothing to prevent a rotation of said valve sleeve with respect to said valve housing.

* * * * *